US006853820B2

(12) United States Patent
Saito et al.

(10) Patent No.: US 6,853,820 B2
(45) Date of Patent: Feb. 8, 2005

(54) METHOD FOR REGENERATING CHARGING MEMBER, CHARGING MEMBER AND DEVICE FOR REGENERATING CHARGING MEMBER

(75) Inventors: Shinichiro Saito, Minamiashigara (JP); Toshiaki Murofushi, Minamiashigara (JP); Kazunari Koga, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/417,186

(22) Filed: Apr. 17, 2003

(65) Prior Publication Data

US 2004/0057749 A1 Mar. 25, 2004

(30) Foreign Application Priority Data

Sep. 19, 2002 (JP) ..... 2002-273995

(51) Int. Cl.[7] ..... G03G 15/00

(52) U.S. Cl. ..... 399/109; 399/176

(58) Field of Search ..... 399/109, 115, 399/168, 174, 175, 176

(56) References Cited

FOREIGN PATENT DOCUMENTS

| | | | |
|---|---|---|---|
| JP | 62-109064 | * | 5/1987 |
| JP | A 6-289755 | | 10/1994 |
| JP | A 7-89627 | | 4/1995 |

* cited by examiner

*Primary Examiner*—Hoang Ngo
(74) *Attorney, Agent, or Firm*—Oliff & Berridge, PLC

(57) ABSTRACT

A method for regenerating a charging member for an electrophotographic system that is pressed against a surface of a body to charge the body, a charging member and a device for regenerating a charging member are provided. The method includes a step of applying heat treatment to the charging member. A used charging member, whose resistance is not decreased enough to recover a required chargeability by cleaning the surface thereof, can easily be regenerated and reused.

16 Claims, 8 Drawing Sheets

METHOD FOR REGENERATING CHARGING MEMBER, CHARGING MEMBER AND DEVICE FOR REGENERATING CHARGING MEMBER

FIELD OF THE INVENTION

The present invention relates to a method for regenerating a charging member which is used in an electrophotographic image-forming apparatus, a charging member, and a device for regenerating a charging member.

DESCRIPTION OF THE RELATED ART

In an electrophotographic image-forming apparatus in which an electrostatic latent image is formed on a photoreceptor and developed with a toner to obtain a toner image, a charging member that applies charges to the photoreceptor while being driven in contact with the surface of the photoreceptor has been widely used. Since charges are applied to the surface of the charging member in the image formation, the toner, a paper powder and the like tend to be adhered to the surface of the charging member. As these materials are adhered to the surface of the charging member, the chargeability of the charging member is decreased, namely, a resistance is increased, so that an image quality deficiency is liable to occur.

A charging member with a chargeability decreased has been ordinarily reused by cleaning materials adhered to the surface to decrease a resistance and recover the chargeability. As a method for regenerating a charging member, a method in which a surface layer having the adhered materials is separated and a new surface layer is formed has been employed. However, it suffers a defect that the treatment cost is high. Accordingly, for example, JP-A-6-289755 and JP-A-7-89627 disclose a cleaning method in which a charging member is scrubbed with a brush in an organic solvent as a cleaning liquid or is sonicated in an organic solvent.

However, charging members in which although the materials adhered to the surfaces are cleaned as noted above, a resistance is not decreased enough to recover a required chargeability cannot be reused, and are actually discarded. Thus, a method for easily regenerating and reusing the charging members whose resistance is not decreased enough to recover a required chargeability by cleaning has been in demand. The invention aims to attain the following subjects upon solving the problems associated with the related art. That is, the invention is to provide a method for regenerating a charging member, which can easily regenerate and reuse a used charging member whose resistance is not decreased enough to recover a required chargeability by cleaning the surface, a charging member, and a device for regenerating a charging member.

SUMMARY OF THE INVENTION

The invention has been made in view of these circumstances, and provides a method for regenerating a charging member, a charging member, and a device for regenerating a charging member.

According to an aspect of the invention, a method for regenerating a charging member for an electrophotographic system that is pressed against a surface of a body to charge the body includes a step of applying heat-treatment to the charging member. According to another aspect of the invention, a charging member for an electrophotographic system that is pressed against a surface of a body to charge the body is regenerated by applying heat treatment. According to another aspect of the invention, a device for regenerating a charging member includes a heat treatment unit that applies heat-treatment to the charging member.

BRIEF DESCRIPTION OF THE DRAWINGS

The preferred embodiments of the invention will be described in detail based on the following figures, wherein.

PREFERRED EMBODIMENTS OF THE INVENTION

Figure 1:
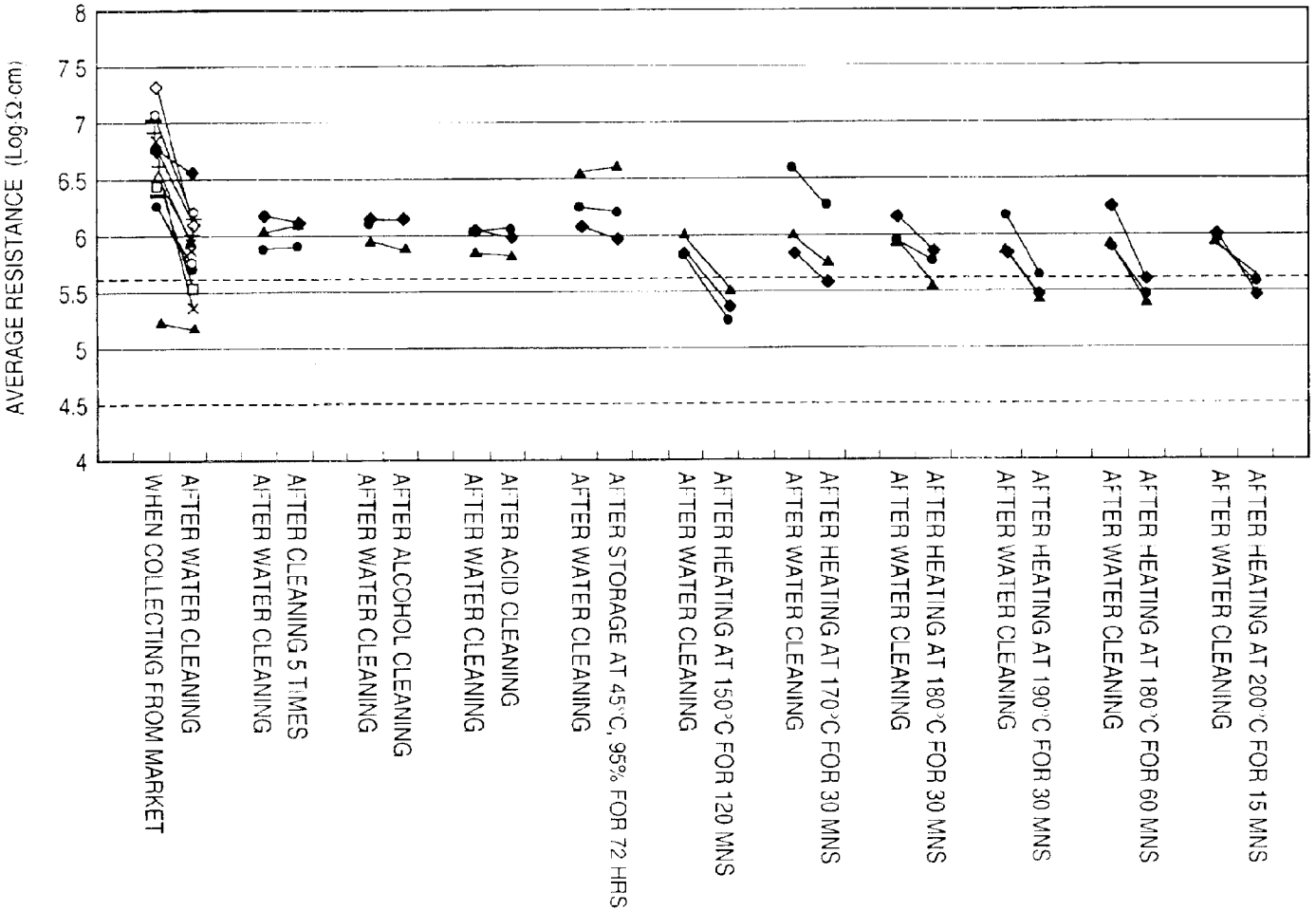
FIG. 1 is a graph showing a resistance after each treatment of charging rolls in Example 1.

The invention is described in detail below.

A method for regenerating a charging member in the invention includes a step of applying heat-treatment to a used charging member collected with a chargeability decreased. The method may further include, as required, a step of cleaning a surface of a charging roll. The cleaning step may be conducted either before or after the heat treatment step.

In the method for regenerating the charging member in the invention, a mechanism of decreasing a resistance by subjecting a used charging member to the heat treatment is not clear, but it is presumed as follows. A used charging member is not decreased enough in resistance to recover a required chargeability by cleaning the surface thereof, because a resistance is increased due to such a change in inner structure that a conductive material contained in a layer (especially a surface layer) constituting the charging member is not uniformly dispersed. By the heat treatment, the inner structure is returned to the original state in which the conductive material is uniformly dispersed again, and the resistance is therefore decreased enough to recover the chargeability.

In the heat treatment step, the charging member is heat-treated. In view of sufficiently decreasing the resistance in good efficiency, the heat treatment temperature is preferably from 150° C. to 200° C., more preferably from 170° C. to 180° C. The heat treatment time is preferably from 15 minutes to 120 minutes, more preferably from 30 minutes to 60 minutes. When an amount of heat provided by the heat treatment is too small, the resistance might not sufficiently be decreased. When it is too large, an inner structure of an ion conductive layer or a surface layer might be destroyed, so that the charging member cannot be used as a charging roll. It is thus advisable that the heat treatment temperature and the heat treatment time are properly adjusted.

A method for practicing the heat treatment step is not particularly limited so long as the charging member can be heat-treated. For example, the heat treatment can be conducted by placing the charging member in an oven. Further, the heat treatment may be conducted batchwise using an oven with a belt conveyor introduced.

The cleaning step is conducted for removing materials (such as a toner and a paper powder) adhered to the surface of the charging member. As a cleaning liquid used in the cleaning step, for example, water, an organic solvent and an acid aqueous solution are available. Further, the charging member may be cleaned by rubbing it in an organic solvent with a brush or by sonicating it unless the surface thereof is damaged.

By conducting such a step, the used charging member with the chargeability decreased can be reused upon recovering the chargeability (charging member of the invention). A regenerating device which is suited for the method for regenerating the charging member (device for regenerating the charging member in the invention) has units that conduct the foregoing step (for example, an oven with a belt conveyor introduced as a heat treatment unit, and a sonicator as a cleaning unit).

In the method for regenerating the charging member in the invention, the charging member is one in which a resistance is not decreased enough to recover a required chargeability by cleaning the surface but is recovered by applying the heat treatment. It is presumed, as stated above, that since the dispersed state of the conductive material contained in a layer (especially a surface layer) constituting the charging member is returned to the uniform state by the heat treatment, the resistance is decreased enough to recover the chargeability. However, its mechanism is not clear, and any charging member in which the resistance is decreased by the heat treatment to recover the chargeability is available in the invention.

Specific examples of such a charging member are as follows.

Charging Member

The charging member has a layer structure that at least an ion conductive layer containing an ion conductive organic material and a surface layer containing carbon black are laminated on a core in this order.

A charging member has generally a conductive elastic layer. In the invention, the ion conductive layer may serve also as the conductive elastic layer, or the ion conductive layer may be formed independently on the conductive elastic layer (another layer may be interposed therebetween), that is, at least the conductive elastic layer may be formed between the core and the ion conductive layer.

Core

As the core in the invention, known metals such as iron, nickel-plated iron, copper and stainless steel can be used. The core generally takes the form of a shaft used so far in a core of a charging member.

Ion Conductive Layer

The ion conductive layer is a layer containing an ion conductive organic material. Generally, it is formed by dispersing the ion conductive organic material and, as required, another conductive material (carbon black, a metal oxide or the like) in a base material and mixing them.

Examples of the ion conductive organic material include quaternary ammonium salts [such as perchlorates, chlorates, borofluorides, sulfates, ethosulfates, halo-benzyl salts (such as bromobenzyl salts and chlorobenzyl salts) of lauryltrimethylammonium, stearyltrimethylammonium, octadodecyltrimethylammonium, dodecyltrimethylammonium, hexadecyltrimethylammonium and modified fatty acid.dimethylethylammonium], aliphatic sulfonic acid salts, higher alcohol sulfonic acid ester salts, higher alcohol ethylene oxide.sulfuric acid ester salts, higher alcohol phosphoric acid ester salts, higher alcohol ethylene oxide.phosphoric acid ester salts, various betaines, higher alcohol ethylene oxides, polyethylene glycol fatty acid esters and polyhydric alcohol fatty acid esters.

Examples of the ion conductive organic material include complexes of polyhydric alcohols (such as 1,4-butanediol, ethylene glycol, polyethylene glycol, propylene glycol and polyethylene glycol) or derivatives thereof and metal salts, and complexes of mono-ols (such as ethylene glycol monomethyl ether and ethylene glycol monoethyl ether) and metal salts. Examples of the metal salts include salts of metals of group I in the periodic table, such as $LiClO_4$, $LiCF_3SO_3$, $LiAsF_6$, $LiBF_4$, $NaClO_4$, NaSCN, KSCN and NaCl; electrolytes such as salts of $NH^{4+}$; salts of metals of group II in the periodic table, such as $Ca(ClO_4)_2$ and $Ba(ClO_4)_2$; and these metal salts having at least one hydroxyl group, carboxyl group or active hydrogen-containing group reactive with an isocyanate, such as a primary or secondary amine group. Specifically, PEL (complex of $LiClO_4$ and polyethylene glycol) is mentioned as the complex.

As the ion conductive organic material, quaternary ammonium salts are preferable in view of a compatibility with the base material. As the quaternary ammonium salts, those having a weight average molecular weight (Mw) of from 100 to 600 are preferable, and those having Mw of from 150 to 300 are more preferable, in view of the bleeding. Further, the quaternary ammonium salts having at least one benzene ring are especially preferable in view of the bleeding.

The ion conductive organic materials may be incorporated in the base material either singly or in combination, and they can be used to meet the requirements as a whole system, such as resistances (surface resistance and volume resistance), dynamic strengths, a hardness and an impact resilience. The amount of the ion conductive organic material incorporated in the base material is preferably from 0.01 to 10 parts by weight, more preferably from 0.1 to 5 parts by weight per 100 parts by weight of the base material.

Examples of the metal oxide used as the conductive material include zinc oxide, titanium oxide, tin oxide and antimony-doped tin oxide.

As a conductive material, carbon black can be used. When acid carbon black is used, an excessive current partially flows to less undergo oxidation due to repetitive application of a voltage. Further, a dispersibility in a base material can be increased with an oxygen-containing functional group adhered to its surface to reduce a nonuniform resistance and decrease a dependence on an electric field, so that concentration of an electric field by passing a current less occurs. Consequently, the change in resistance by passing a current is prevented, a uniformity of a resistance is improved, a dependence on an electric field is decreased, and the change in resistance by the environmental change is reduced. Thus, the uniform charging is enabled. It is therefore possible to prevent concentration of an electric field caused by a large aggregate of carbon black, leak discharge considered to occur by insulation breakdown, such as pinhole leak, and also adhesion of a toner. Further, an image quality defect caused by the nonuniform charging due to the change in resistance or the nonuniform resistance or by the leak discharge and the change in image density by the environmental change are reduced, whereby a high-quality image can be obtained over a long period of time. Still further, carbon black eliminates the need of coupling treatment for improving a dispersibility or addition of insulated particles or metal oxides to simplify the process. Furthermore, since carbon black is electronically conductive, there is no problem of contamination (bleeding) with an ion conductive material containing, for example, an ether segment which tends to contaminate an image carrier. Accordingly, it is unnecessary to form a layer for preventing the bleeding. Thus, the process is likewise simplified.

Acid carbon black contains, on the surface, large amounts of functional groups such as an oxygen-containing functional group [a carboxylic acid group or a hydroxyl group (for example, a phenolic hydroxyl group)], a lactone group and a quinoid group. Generally, the oxygen-containing functional group on the surface of carbon black can impart a polarity to carbon black made of carbon alone to improve an affinity for a base material (binder polymer) and can uniformly disperse carbon black therein. This has been widely recognized in a system containing a solvent, such as ink or paint. It is presumed that this is also established in kneading and dispersing in a dry state.

Carbon black can be produced by a contact method. Examples of the contact method include a channel method and a gas black method. Further, carbon black can also be produced by a furnace black method using a gas or oil as a raw material. After these treatments are conducted, oxidation in an aqueous phase may be conducted with nitric acid as required. Incidentally, although carbon black can be produced by the contact method, this contact method is currently little performed in view of a problem of environmental pollution, and carbon black is commonly produced by the furnace method of a closed system. In the furnace method, only carbon black having high pH and a low volatile content is generally produced. It is possible to adjust pH of this carbon black by subjecting it to the foregoing acid treatment in the aqueous phase. Thus, carbon black obtained by this furnace method and adjusted to pH of less than 6 through the subsequent treatment is also included in the invention.

Examples of carbon black include "Color Black FW200" (pH 2.5, volatile content 20%), "FW2" (pH 2.5, volatile content 16.5%), "FW2V" (pH 2.5, volatile content 16.5%), "Special Black 6" (pH 2.5, volatile content 18%), "5" (pH 3, volatile content 15%), "4" (pH 3, volatile content 14%), "4A" (pH 3, volatile content 14%) and "Printex 150T" (pH 4, volatile content 10%) made by Degussa AG [although these carbon blacks are produced by a gas black method similar to a channel method, they are grouped into channel black by those skilled in the art]; "REGAL 400R" (pH 4.0, volatile content 3.5%), "MONARCH 1000" (pH 2.5, volatile content 9.5%), "MONARCH 1300" (pH 2.5, volatile content 9.5%) and "MOGUL L" (pH 2.5, volatile content 4.5%) made by Cabot; and "3030B" (pH 6.5, volatile content 0.5%) made by Mitsubishi Chemical Corp.

The conductive materials may be incorporated in the base material either singly or in combination, and can be used to meet the requirements as a whole system, such as resistances as an elastic layer (surface resistance and volume resistance), dynamic strengths, a hardness and an impact resilience. The amount of the conductive material incorporated in the base material may properly be adjusted to meet the requirements as a whole system. It is preferably from 5 to 50 parts by weight per 100 parts by weight of the base material.

The base material of the ion conductive layer is not particularly limited, and known materials are available. Especially when the ion conductive material serves also as the conductive elastic layer, a material having a desired elasticity is preferable. Examples thereof include resin materials such as polyimide, polyester, polyether ether ketone, polyamide, polycarbonate, polyvinylidene fluoride (PVDF) and polyfluoroethylene-ethylene copolymer (ETFE); elastic materials such as polyurethane, chlorinated polyisoprene, acrylonitrile-butadiene rubber (NBR), chloroprene rubber, ethylene-propylene-diene rubber (EPDM), hydrogenated polybutadiene, butyl rubber, silicone rubber, acrylic rubber and epichlorohydrin rubber. Thermoplastic elastomers, heat-shrinkable (thermosetting) rubbers, expandable rubbers and non-diene rubbers can also advantageously be used. It is also possible to use them as an alloy (blend) of two or more thereof.

Of these, a base material made mainly of epichlorohydrin rubber is preferable in view of a uniform resistance and a resistance stability. Incidentally, "made mainly of epichlorohydrin rubber" means that a main component of a base material is epichlorohydrin rubber, and a component that occupies more than 50% by weight of a base material is included in the concept of "made mainly of".

In the ion conductive layer, a curing agent, a plasticizer and a vulcanization accelerator may be used, as required, in addition to the ion conductive organic material, the specific carbon black and the base material. In case of the foaming, a foaming agent can also properly be used.

The thickness of the ion conductive layer is preferably 0.8 mm or more, more preferably from 1 to 5 mm, further preferably from 2 to 5 mm. When the thickness of the ion conductive layer is less than 0.8 mm, the ionic component of the ion conductive layer is isolated owing to the influence of the applied voltage, so that a resistance might be increased to notably reduce a charged potential Vh.

When the ion conductive layer serves also as the conductive elastic layer, the greater thickness is preferable for exhibiting also a performance as the conductive elastic layer. The thickness is not particularly limited. It is preferably from 1 to 10 mm, more preferably from 2 to 5 mm.

The ion conductive layer can be formed by dissolving the base material, the ion conductive organic material, the specific carbon black and, as required, other materials in an appropriate solvent and coating the mixture on the core or the conductive elastic layer formed on the core, by kneading the ion conductive organic material with the base material and winding the mixture on the core or the conductive elastic layer formed on the core to press it, or by a known molding method such as injection molding. In case of forming the ion conductive layer by coating, multiple-coating is desirable for securing a predetermined thickness.

Conductive Elastic Layer Independent from the Ion Conductive Layer

When the ion conductive layer does not serve as the conductive elastic layer, at least an independent conductive elastic layer is formed between the core and the ion conductive layer.

The conductive elastic layer is made of a conductive elastic material, and meets the foregoing volume resistance. The material and the composition are not particularly limited. It is usually formed by dispersing a conductive material in a base material. Examples of the conductive material include an ion conductive organic material, carbon black and a metal oxide, and those listed in the ion conductive layer can be used as such.

The conductive materials may be incorporated in the base material either singly or in combination, and can be used to meet the requirements as a whole system, such as resistances (surface resistance and volume resistance), dynamic strengths, a hardness and an impact resilience. The amount of the conductive material incorporated in the base material may properly be adjusted to meet the foregoing volume resistance. In general, it is preferably from 0.01 to 200 phr ["phr" means part(s) by weight per 100 parts by weight of a base material].

As the base material used in the conductive elastic material, those listed in the ion conductive layer can be used as such. In the conductive elastic layer, a curing agent, a plasticizer and a vulcanization accelerator may be used as required. In case of the foaming, a foaming agent can also properly be used. The thickness of the conductive elastic layer is not particularly limited. It is preferably from 1 to 10 mm, more preferably from 2 to 5 mm.

The conductive elastic layer can be formed by dissolving the base material, the conductive material and, as required, other materials in an appropriate solvent and coating the mixture on the core, by kneading the conductive material with the base material and winding the mixture on the core to press it, or by a known molding method such as injection molding. In case of forming the conductive elastic layer by coating, multiple-coating is desirable for securing a predetermined thickness.

Surface Layer

The surface layer is a layer that acts to adjust a resistance, to block materials bled from the elastic layer or the ion conductive layer and to allow protection from contaminants, and it is formed by dispersing a conductive material in a base material. The surface layer contains carbon black as a conductive material, and other conductive materials (such as an ion conductive organic material and a metal oxide) may be used in combination. With respect to the ion conductive organic material, the carbon black and the metal oxide as the conductive materials, those listed in the ion conductive layer can be used. Materials having pH of less than 6.0 are preferable.

The conductive materials may be incorporated in the base material either singly or in combination, and can be used to meet the requirements as a whole system, such as resistances (surface resistance and volume resistance), dynamic strengths, a hardness and an impact resilience. In general, the amount of the conductive material incorporated in the base material is preferably from 1 to 200 phr ["phr" means part(s) by weight per 100 parts by weight of a base material].

As the base material of the surface layer, those listed in the ion conductive layer or the conductive elastic layer can be used. In view of film strength and bleeding, a thermosetting resin formed by crosslinking an aliphatic polyester resin with a melamine resin is preferably used in the surface layer.

The amount of the melamine resin is preferably from 30 to 70 parts by weight, more preferably from 40 to 60 parts by weight per 100 parts by weight of the aliphatic polyester resin, as a ratio of mixing the both. When the amount of the melamine resin is less than 30 parts by weight, a non-crosslinked portion remains, and the resulting surface layer is sticky, so that tacking to a photoreceptor tends to occur. When it exceeds 70 parts by weight, a degree of crosslinking is increased, and the resulting surface layer becomes brittle and hard, so that cracking tends to occur. Thus, both cases are undesirable.

When the thermosetting resin is used as the base material of the surface layer, it is advisable that the surface layer further contains a fluorine-containing polymer compound and/or a silicone polymer compound in view of prevention of contamination such as adhesion of a toner and a resistance environmental stability. It is advisable that the fluorine-containing polymer compound and/or the silicone polymer compound is contained as fine particles having a particle size of less than 15 $\mu$m in view of a durability and surface characteristics. The particle size of such fine particles is preferably from 0.1 to 5 $\mu$m.

The amount of the fluorine-containing polymer compound and/or the silicone polymer compound is preferably from 5 to 100 parts by weight, more preferably from 20 to 60 parts by weight per 100 parts by weight of the thermosetting resin. When the amount is less than 5 parts by weight, the effect obtained by containing it is not provided. When it exceeds 100 parts by weight, a processability is notably decreased, the film is brittle, and the effect of preventing adhesion of a toner by the increase in amount is not provided. Further, the cost is increased disadvantageously.

The surface layer can be formed by dissolving the base material, the conductive material and, as required, other materials in an appropriate solvent and coating the mixture on the core, by kneading the conductive material with the base material and winding the mixture on the core to press it, or by a known molding method such as injection molding. In case of forming the surface layer by coating, multiple-coating is desirable for securing a predetermined thickness. When the thermosetting resin is used as the base material, it is advisable to heat the resin at a sufficient curing temperature after coating or molding.

In the method for regenerating the charging member in the invention, other examples of the charging member are listed below.

- charging member in which an elastic layer containing SBR (styrene-butadiene rubber), a plasticizer and carbon black, a resistive layer containing ECO (epichlorohydrin rubber) and an ion conductive material and a surface layer containing PA (polyamide), carbon black and $SnO_2$ are laminated on a core in this order.
- charging member in which an elastic layer containing EPDM (ethylene-propylene-diene copolymer rubber) and carbon black, a resistive layer containing ECO and an ion conductive material and a surface layer containing PA (polyamide), carbon black and $SnO_2$ are laminated on a core in this order.
- charging member in which an elastic layer containing EPDM and carbon black, a resistive layer containing NBR (acrylonitrile-butadiene copolymer rubber), carbon black and an ion conductive material and a surface layer containing an acrylic resin are laminated on a core in this order.
- charging member in which an elastic layer containing BR (butadiene rubber), IR (isoprene rubber), a plasticizer and carbon black, a resistive layer containing urethane, carbon black and a conductive material, a migration preventing layer and a surface layer containing PA, carbon black and $SnO_2$ are laminated on a core in this order.

charging member in which an elastic layer containing urethane and carbon black and a resistive layer (surface layer) containing urethane, carbon black and $SnO_2$ are laminated on a core in this order.

charging member in which an elastic layer containing urethane and carbon black, a resistive layer containing an acrylic rubber and carbon black and a surface layer containing a mixture of vinylidene chloride and PTEF (polytetrafluoroethylene) and a thermoplastic polyester [PET (polyethylene terephthalate) and PBT (polybutylene terephthalate)] are laminated on a core in this order.

charging member in which an elastic layer containing a silicone resin and carbon black and a surface layer containing PA, carbon black, Mg and $SnO_2$ are laminated on a core in this order.

charging member in which an elastic layer containing EPDM and carbon black and a surface layer containing thermoplastic polyurethane, carbon black and $SnO_2$ are laminated on a core in this order.

charging member in which an elastic layer containing ECO, carbon black and an ion conductive material and a surface layer containing polyurethane are laminated on a core in this order.

charging member in which an elastic layer containing SBR and carbon black, a barrier layer containing PA and carbon black, a resistive layer containing ECO and an ion conductive material and a surface layer containing a nylon resin are laminated on a core in this order.

The foregoing charging members are preferable as the charging member used in the method for regenerating the charging member in the invention. However, these are not critical.

The charging member regenerated by the method for regenerating the charging member in the invention as stated above can advantageously be reused as a charging member in a contact-type charging unit in electrophotographic apparatus such as copying machines, laser printers, facsimiles and OA appliances being a combination thereof.

Figure 9:
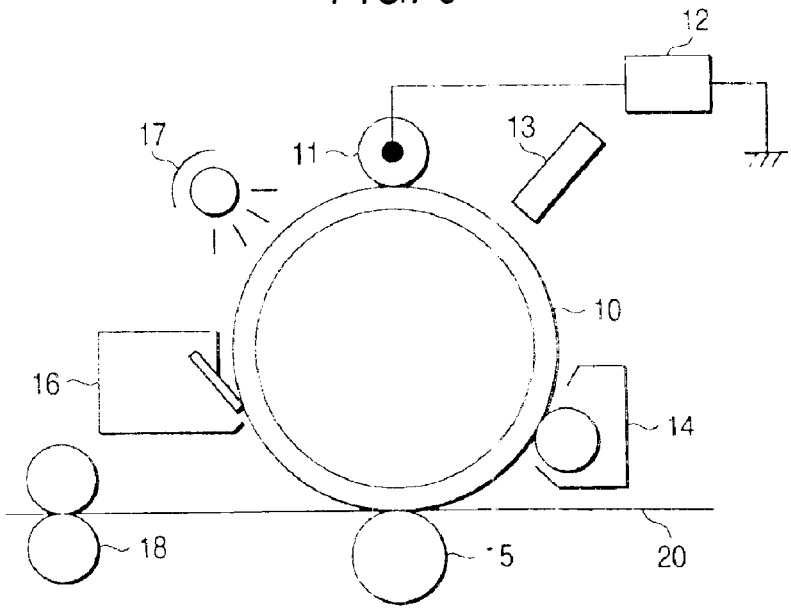
FIG. 9 is a schematic structural view showing an example of an image-forming apparatus in which a charging member regenerated by the regenerating method of the invention is reused.

An electrophotographic apparatus in which the charging member regenerated by the method for regenerating the charging member in the invention is reused, is described in detail by referring to the drawing. FIG. 9 is a schematic sectional view of an example of an electrophotographic apparatus to which the charging member of the invention is applied. The electrophotographic apparatus shown in FIG. 9 has an electrophotographic photoreceptor 10, a charging unit 11 including the charging member of the invention that charges the surface of the electrophotographic photoreceptor 10, a power supply 12 that applies a voltage to the charging unit 11, an image input unit 13 that forms a latent image on the surface of the electrophotographic photoreceptor 10, a developing unit 14 that develops the latent image formed on the surface of the electrophotographic photoreceptor 10 with a toner to obtain a toner image, a transfer unit 15 that transfers the formed toner image onto a surface of a transfer medium 20, a cleaning unit 16 that removes a residual toner on the surface of the electrophotographic photoreceptor 10, an electricity removal unit 17 that removes a residual potential on the surface of the electrophotographic photoreceptor 10 and a fixing unit 18 that fixes the toner image transferred onto the surface of the transfer medium 20 with heat and/or pressure.

The charging unit 11 including the charging member is actuated with a voltage supplied from the power supply 12 to charge the surface of the photoreceptor. The structures of the image input unit 13, the developing unit 14, the transfer unit 15, the cleaning unit 16, the electricity removal unit 17 and the fixing unit 18 are not particularly limited in the invention, and any known structures in the electrophotographic field can be applied as such. The electricity removal unit 17 is not necessarily provided.

The operation of the electrophotographic apparatus in FIG. 9 is described below. The surface of the electrophotographic photoreceptor 10 is uniformly charged with the charging unit 11, and a latent image is then formed with the image input unit 13. The latent image formed on the surface of the electrophotographic photoreceptor 10 is developed with a toner filled in the developing unit 14 to form a toner image. The toner image formed on the surface of the electrophotographic photoreceptor 10 is transferred onto the surface of the transfer medium 20 inserted between the electrophotographic photoreceptor 10 and the transfer unit 15 opposite thereto, and further fixed with heat and/or pressure of the fixing unit 18. Meanwhile, a residual toner on the surface of the electrophotographic photoreceptor 10 after the transfer is removed with the cleaning unit 16. Before the next image-forming cycle, the residual potential on the surface of the electrophotographic photoreceptor 10 is removed with the electricity removal unit 17.

EXAMPLES

The invention is illustrated more specifically below by referring to Examples. However, the invention is not limited by these Examples.

Example 1

Experiments are conducted using a charging roll for a developing cartridge used in a laser copying machine (trade name: Able 1320) manufactured by Fuji Xerox Co., Ltd.

(Charging Roll)

A stainless steel core having a length of 331 mm and a diameter of 8 mm is used. An ion conductive layer serving also as a conductive elastic layer and a surface layer, which have compositions and thicknesses shown in Table 1, are formed on the core in this order through a phenolic conductive adhesive ("U-20" made by Toyo Chemical Laboratories, Inc.) to produce a charging roll. A DBP oil absorption of carbon black ("3030B" made by Mitsubishi Chemical) used in the ion conductive layer is 130 ml/100 g.

TABLE 1

| | | Composition |
|---|---|---|
| Ion conductive layer | | |
| Rubber | epichlorohydrin | 96 wt. % |
| | NBR | 4 wt. % |
| Vulcanizing agent | sulfur | 0.5 phr |
| | TT* | 1.5 phr |
| | DM* | 1.5 phr |
| Reinforcing agent | carbon black* | 20 phr |
| Conductive material | quaternary ammonium salt* | 1.8 phr |
| | Thickness | 3 mm |
| Surface layer | | |
| Resin | melamine* | 35 wt. % |
| | polyester* | 65 wt. % |
| Filler | fluororesin* | 30 phr |

TABLE 1-continued

| | | Composition |
|---|---|---|
| Conductive material | carbon black* | 14 phr |
| | Thickness | 5 μm |

TT: tetramethylthiuram disulfide
DM: dibenzothiazyl disulfide
carbon black (ion conductive layer): "3030B", Mitsubishi Chemical
quaternary ammonium salt: benzyltriethylammonium chloride
melamine resin: "Super Beckamin G821-60", DIC
polyester resin: "Vyron 30SS", Toyobo
fluororesin: "Rubron L-2", Daikin
carbon black (surface layer): "FW200", Degussa AG The ion conductive layer and the surface layer in the charging roll are formed as follows.

Ion Conductive Layer

The materials for forming the ion conductive layer as shown in Table 1 are kneaded with an open roll, and a roll having a diameter of 15 mm is obtained using a press molding machine. The roll is then polished to a diameter of 14 mm.

Surface Layer

The materials for forming the surface layer as shown in Table 1 are uniformly dispersed with a Dyno mill to obtain a solution for forming the surface layer. The solution for forming the surface layer is dip-coated, and calcined by heating at 160° C. for 30 minutes to form the surface layer having the thickness shown in Table 1.

reference values when collecting from the market and after water cleaning are measured. The results are shown in FIG. 1.

Figure 2:
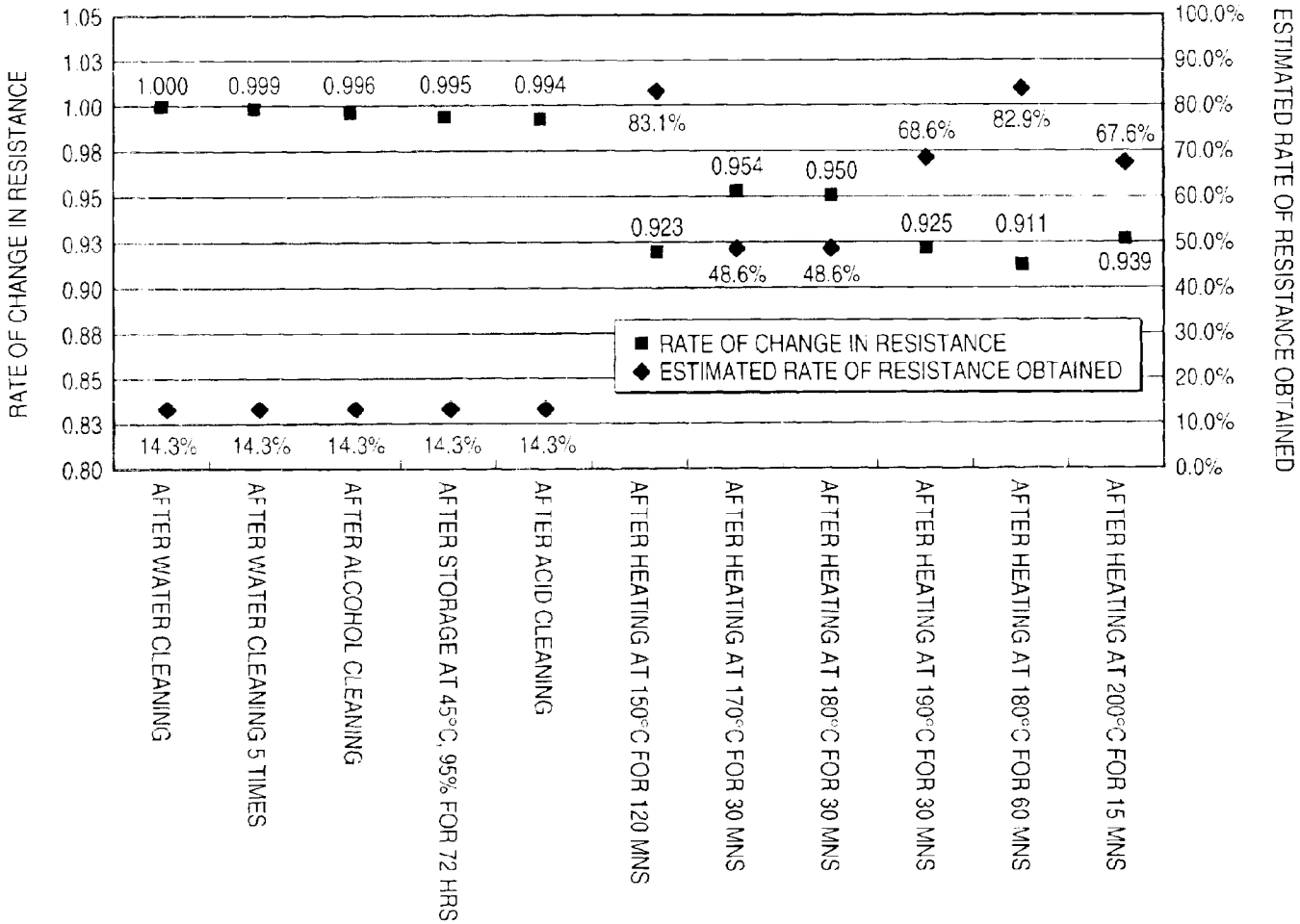
FIG. 2 is a graph showing a rate of change in resistance and an estimated rate of resistance obtained after each treatment in Example 1.

Further, a rate of change in resistance and an estimated rate of resistance obtained on the basis of these results are shown in FIG. 2. A measured resistance is shown in terms of an average value. With respect to the rate of change in resistance, in the experiment with the three charging rolls, the average resistances after each treatment are divided by the average resistances before each treatment, and the resulting values are divided by 3 to obtain an average value. Further, with respect to the estimated rate of resistance obtained, average resistances after water cleaning of the charging rolls collected from the market are multiplied by the rates of change in resistance in each treatment, and the resulting values are divided by 3 to obtain an average value. The average resistance data after water cleaning of the charging rolls collected from the market is shown in Table 3.

The heat treatment is conducted by placing the samples in an oven.

The cleaning treatment is conducted by rubbing the samples with a sponge using each cleaning liquid and then cleaning them with water. Methanol is used as an alcohol. A 1% aqueous solution of DL-malic acid is used as an acid.

The resistance is measured by contacting the charging roll with an electrode roll 5 mm in width under a constant load in a measuring atmosphere of 23° C. and 53% RH, applying a DC voltage of 100 V to the core of the charging roll while rotating the charging roll and measuring a current value.

TABLE 2

Change in resistance by each treatment

| Experiment 1 (Comparative Example) | | Experiment 2 (Comparative Example) | | Experiment 3 (Comparative Example) | | Experiment 4 (Comparative Example) | | Experiment 5 (Example) | |
|---|---|---|---|---|---|---|---|---|---|
| After water cleaning | After water cleaning 5 times | After water cleaning | After alcohol cleaning | After water cleaning | After acid cleaning | After water cleaning | After storage at 45° C. and 95% for 72 hrs | After water cleaning | After heating at 150° C. for 120 mns |
| 5.87 | 5.89 | 6.10 | 6.12 | 6.04 | 6.03 | 6.22 | 6.19 | 5.77 | 5.35 |
| 6.05 | 6.09 | 5.97 | 5.90 | 5.86 | 5.83 | 6.57 | 6.60 | 6.01 | 5.47 |
| 6.18 | 6.09 | 6.16 | 6.13 | 6.03 | 5.96 | 6.06 | 5.97 | 5.79 | 5.40 |

| Experiment 6 (Example) | | Experiment 7 (Example) | | Experiment 8 (Example) | | Experiment 9 (Example) | | Experiment 10 (Example) | |
|---|---|---|---|---|---|---|---|---|---|
| After water cleaning | After heating at 170° C. for 30 mns | After water cleaning | After heating at 180° C. for 30 mns | After water cleaning | After heating at 190° C. for 30 mns | After water cleaning | After heating at 180° C. for 60 mns | After water cleaning | After heating at 200° C. for 15 mns |
| 6.56 | 6.24 | 5.91 | 5.73 | 6.13 | 5.59 | 5.85 | 5.44 | 5.92 | 5.57 |
| 5.98 | 5.72 | 5.93 | 5.54 | 5.82 | 5.38 | 5.91 | 5.37 | 5.90 | 5.58 |
| 5.81 | 5.54 | 6.14 | 5.81 | 5.79 | 5.43 | 6.24 | 5.58 | 5.98 | 5.56 |

unit: Log · Ω · cm (Experiments)

After the copying of 23,500 sheets, the charging roll is withdrawn from the developing cartridge of the copying machine to produce a test sample. After this sample is subjected to each treatment (cleaning treatment or heat treatment) shown in Table 2, a resistance is measured. Each experiment is performed using three charging rolls. The results are shown in Table 2. The results in Table 2 are graphically illustrated in FIG. 1. An average resistance specification is from 4.50 to 5.60 (Log·Ω·cm). Incidentally, ten charging rolls (having the foregoing structure) collected from the market are selected, and resistances thereof as a

TABLE 3

Average resistance data after water cleaning of charging rolls collected from the market

| No. | Average resistance |
|---|---|
| 1 | 5.85 |
| 2 | 5.22 |
| 3 | 5.78 |
| 4 | 5.70 |

TABLE 3-continued

| Average resistance data after water cleaning of charging rolls collected from the market | |
|---|---|
| No. | Average resistance |
| 5 | 6.22 |
| 6 | 6.57 |
| 7 | 6.06 |
| 8 | 5.97 |
| 9 | 5.90 |
| 10 | 6.14 |
| 11 | 6.56 |
| 12 | 5.98 |
| 13 | 5.81 |
| 14 | 5.91 |
| 15 | 5.93 |
| 16 | 6.14 |
| 17 | 6.13 |
| 18 | 5.82 |
| 19 | 5.79 |
| 20 | 5.93 |
| 21 | 5.81 |
| 22 | 5.85 |
| 23 | 5.85 |
| 24 | 5.91 |
| 25 | 6.24 |
| 26 | 5.49 |
| 27 | 5.54 |
| 28 | 5.79 |
| 29 | 5.59 |
| 30 | 5.37 |
| 31 | 5.74 |
| 32 | 6.20 |
| 33 | 5.80 |
| 34 | 6.17 |
| 35 | 6.08 |
| 36 | 5.87 |
| 37 | 5.27 |
| 38 | 5.56 |
| 39 | 6.05 |
| 40 | 6.18 |
| 41 | 5.69 |
| 42 | 5.77 |
| 43 | 6.04 |
| 44 | 5.82 |
| 45 | 5.86 |
| 46 | 5.82 |
| 47 | 6.03 |
| 48 | 6.10 |
| 49 | 5.97 |
| 50 | 6.16 |
| 51 | 5.86 |
| 52 | 5.71 |
| 53 | 5.84 |
| 54 | 5.89 |
| 55 | 5.75 |
| 56 | 5.78 |
| 57 | 6.02 |
| 58 | 5.71 |
| 59 | 6.02 |
| 60 | 5.87 |
| 61 | 6.04 |
| 62 | 5.77 |
| 63 | 6.05 |
| 64 | 5.12 |
| 65 | 5.79 |
| 66 | 5.50 |
| 67 | 5.73 |
| 68 | 5.62 |
| 69 | 5.99 |
| 70 | 5.53 |
| 71 | 5.79 |
| 72 | 5.74 |
| 73 | 5.76 |
| 74 | 5.77 |
| 75 | 5.74 |
| 76 | 5.69 |
| 77 | 5.83 |

TABLE 3-continued

| Average resistance data after water cleaning of charging rolls collected from the market | |
|---|---|
| No. | Average resistance |
| 78 | 5.78 |
| 79 | 5.99 |
| 80 | 5.52 |
| 81 | 6.05 |
| 82 | 5.78 |
| 83 | 5.69 |
| 84 | 5.68 |
| 85 | 6.11 |
| 86 | 6.09 |
| 87 | 5.66 |
| 88 | 5.73 |
| 89 | 5.87 |
| 90 | 5.45 |
| 91 | 6.09 |
| 92 | 5.50 |
| 93 | 5.42 |
| 94 | 5.95 |
| 95 | 5.47 |
| 96 | 5.99 |
| 97 | 6.31 |
| 98 | 5.78 |
| 99 | 5.51 |
| 100 | 5.94 |
| 101 | 5.90 |
| 102 | 5.91 |
| 103 | 5.88 |
| 104 | 5.83 |
| 105 | 5.53 |
| 106 | 5.18 |
| 107 | 5.87 |
| 108 | 5.84 |
| 109 | 5.81 |
| 110 | 5.80 |
| 111 | 6.11 |
| 112 | 5.30 |
| 113 | 6.00 |
| 114 | 6.01 |
| 115 | 5.95 |
| 116 | 5.67 |
| 117 | 5.80 |
| 118 | 5.68 |
| 119 | 5.28 |
| 120 | 5.34 |
| 121 | 6.16 |
| 122 | 6.32 |
| 123 | 5.73 |
| 124 | 5.71 |
| 125 | 6.04 |
| 126 | 5.99 |
| 127 | 5.73 |
| 128 | 5.98 |
| 129 | 6.05 |
| 130 | 6.25 |
| 131 | 5.90 |
| 132 | 5.68 |
| 133 | 5.82 |
| 134 | 5.83 |
| 135 | 6.25 |
| 136 | 5.84 |
| 137 | 6.09 |
| 138 | 5.91 |
| 139 | 5.75 |
| 140 | 6.43 |
| 141 | 5.83 |
| 142 | 5.21 |
| 143 | 6.46 |
| 144 | 6.02 |
| 145 | 5.63 |
| 146 | 5.84 |
| 147 | 6.05 |
| 148 | 5.88 |

unit: Log · Ω · cm

The results in Table 2 (FIGS. 1 and 2) reveal that by the cleaning only, the resistance is not decreased to a required value, whereas by the heat treatment, the resistance is greatly decreased and the charging roll can be reused. With respect to the rate of change in resistance and the estimated rate of resistance obtained, it is found that as the amount of heat applied to the used charging roll is increased, the good results are provided on the rate of change in resistance and the estimated rate of resistance obtained.

Reference Examples

The same charging roll as used in Example 1 is installed on a laser copying machine (trade name: Able 1320) manufactured by Fuji Xerox Co., Ltd. After the copying of 23,500 sheets, the charging roll is withdrawn therefrom, and subjected to the following experiments. Each experiment is performed using ten charging rolls.

Change in Resistance After Water Cleaning and After Heat Treatment

Figure 3:
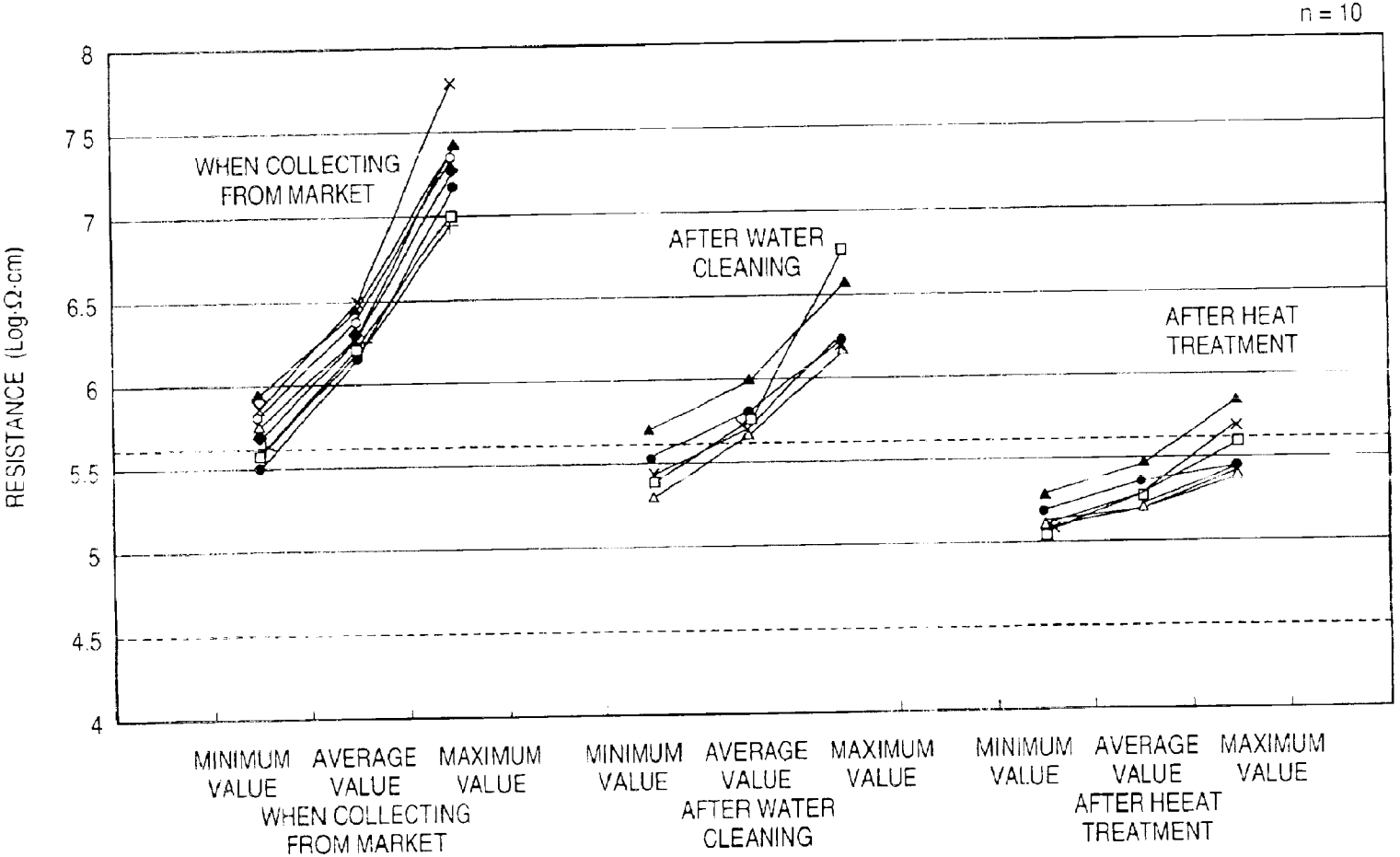
FIG. 3 is a graph showing the change in resistance after water cleaning and after heat treatment of charging rolls in Reference Examples.

The resistance when collecting used charging rolls from the market, after water cleaning thereof and after heat treatment (in an oven at 180° C. for 60 minutes) thereof is measured as in Example 1. The results are shown in Table 4, and also graphically illustrated in FIG. 3.

TABLE 4

Change in resistance after water cleaning and after heat treatment

| | When collecting from market | | | After water cleaning | | | After heat treatment | | |
|---|---|---|---|---|---|---|---|---|---|
| | Minimum resistance | Average resistance | Maximum resistance | Minimum resistance | Average resistance | Maximum resistance | Minimum resistance | Average resistance | Maximum resistance |
| 1 | 5.49 | 6.17 | 7.20 | 5.52 | 5.79 | 6.25 | 5.19 | 5.33 | 5.48 |
| 2 | 5.68 | 6.30 | 7.27 | 5.42 | 5.73 | 6.29 | 5.13 | 5.21 | 5.35 |
| 3 | 5.49 | 6.20 | 7.17 | 5.26 | 5.62 | 6.22 | 5.05 | 5.21 | 5.45 |
| 4 | 5.94 | 6.47 | 7.44 | 5.69 | 5.99 | 6.60 | 5.28 | 5.46 | 5.85 |
| 5 | 5.69 | 6.34 | 7.18 | 5.32 | 5.79 | 6.72 | 5.10 | 5.29 | 5.71 |
| 6 | 5.59 | 6.23 | 6.96 | 5.34 | 5.74 | 6.58 | 5.10 | 5.28 | 5.52 |
| 7 | 5.57 | 6.22 | 7.01 | 5.38 | 5.76 | 6.78 | 5.05 | 5.28 | 5.59 |
| 8 | 5.76 | 6.28 | 7.46 | 5.32 | 5.77 | 6.20 | 5.10 | 5.18 | 5.38 |
| 9 | 5.82 | 6.39 | 7.84 | 5.35 | 5.74 | 6.60 | 5.03 | 5.18 | 5.73 |
| 10 | 5.84 | 6.50 | 7.81 | 5.34 | 5.69 | 6.27 | 5.03 | 5.18 | 5.50 |

unit: Log · Ω · cm

The results in Table 4 (FIG. 3) reveal that the resistance of all the ten charging rolls is greatly decreased by the heat treatment.

Change in Outer Diameter After Water Cleaning and After Heat Treatment

An outer diameter of new charging rolls (NEW) and charging rolls after water cleaning and after heat treatment is measured. The outer diameter is measured in the following positions.

D1: position which is 20 mm inwards axially from one end of the charging roll (surface layer)

D2: center

D3: position which is 20 mm inwards axially from another end of the charging roll (surface layer).

Figure 4:
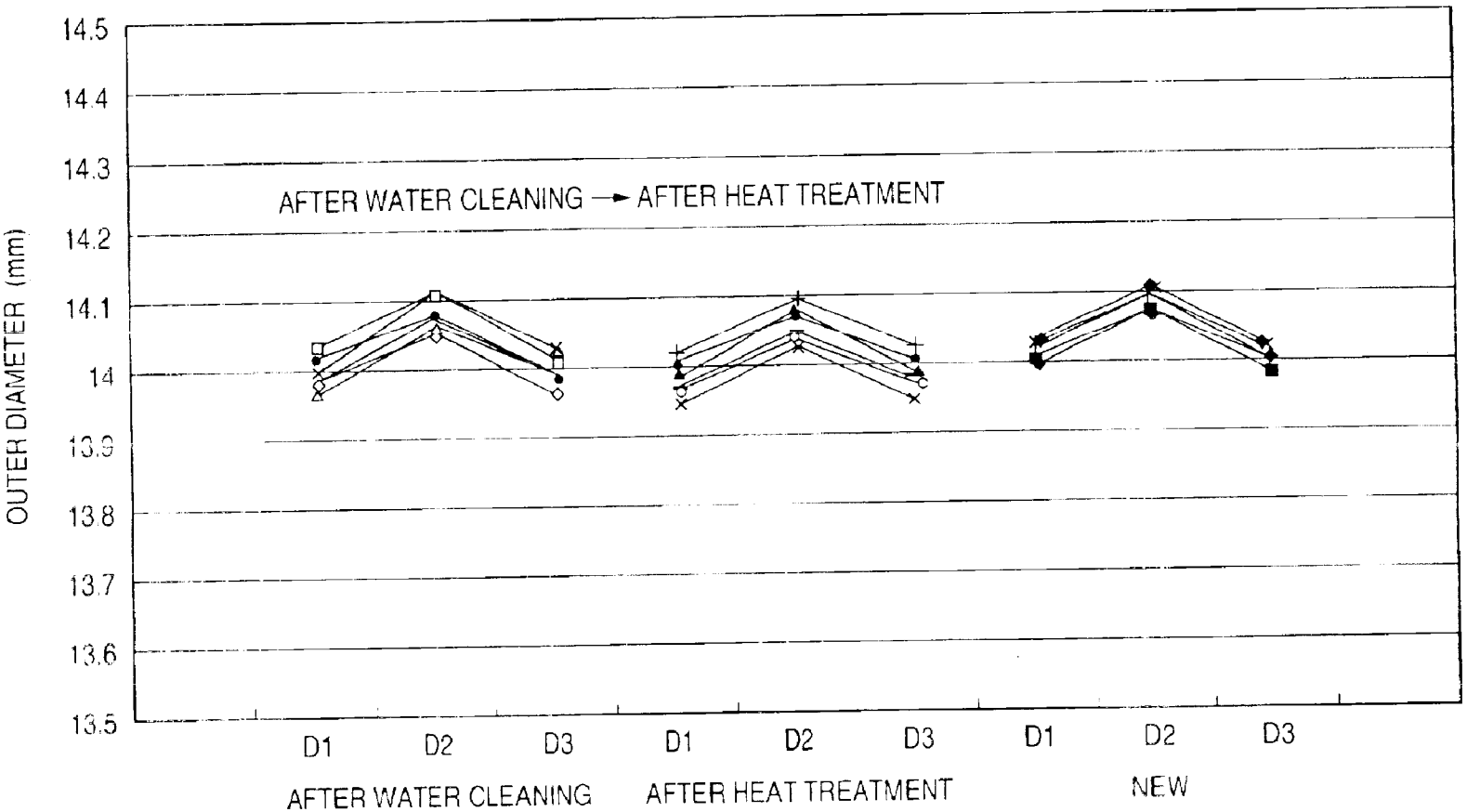
FIG. 4 is a graph showing the change in outer diameter after water cleaning and after heat treatment of charging rolls in Reference Examples.

The outer diameter data of new charging rolls (NEW) is a data (reference value) of samples produced in another lot. The results are shown in Table 5, and graphically illustrated in FIG. 4.

TABLE 5

Change in outer diameter after water cleaning and after heat treatment

| | After water cleaning | | | After heat treatment | | | NEW | | |
|---|---|---|---|---|---|---|---|---|---|
| | D1 | D2 | D3 | D1 | D2 | D3 | D1 | D2 | D3 |
| 1 | 13.974 | 14.072 | 13.997 | 13.949 | 14.045 | 13.969 | 14.027 | 14.108 | 14.009 |
| 2 | 14.028 | 14.117 | 14.035 | 14.002 | 14.090 | 14.010 | 14.030 | 14.113 | 14.013 |
| 3 | 14.012 | 14.082 | 14.003 | 13.984 | 14.058 | 13.981 | 14.003 | 14.071 | 13.984 |
| 4 | 14.015 | 14.091 | 13.991 | 13.982 | 14.063 | 13.967 | 14.032 | 14.107 | 14.000 |
| 5 | 14.016 | 14.110 | 14.038 | 13.985 | 14.080 | 14.006 | 14.033 | 14.106 | 14.000 |
| 6 | 13.983 | 14.058 | 13.968 | 13.948 | 14.029 | 13.941 | 14.019 | 14.100 | 13.999 |
| 7 | 14.039 | 14.113 | 14.013 | 14.004 | 14.084 | 13.987 | 14.031 | 14.102 | 13.993 |
| 8 | 14.037 | 14.110 | 14.027 | 14.007 | 14.083 | 14.001 | 14.030 | 14.099 | 13.989 |
| 9 | 14.056 | 14.137 | 14.043 | 14.024 | 14.106 | 14.017 | 13.993 | 14.099 | 14.029 |
| 10 | 13.991 | 14.080 | 13.999 | 13.962 | 14.050 | 13.971 | 14.024 | 14.111 | 14.021 |

unit: mm

The results in Table 5 (FIG. 3) reveal that although the outer diameter is decreased by approximately 0.02 mm through the heat treatment, the charging roll is still retained at the practical level and can be reused in a good condition.

Change in Crown Value After Water Cleaning and After Heat Treatment

On the basis of the results in Table 5, the change in crown value represented the following formula is also measured.

$$\text{Crown value}=D2-(D1+D3)/2$$

Figure 5:
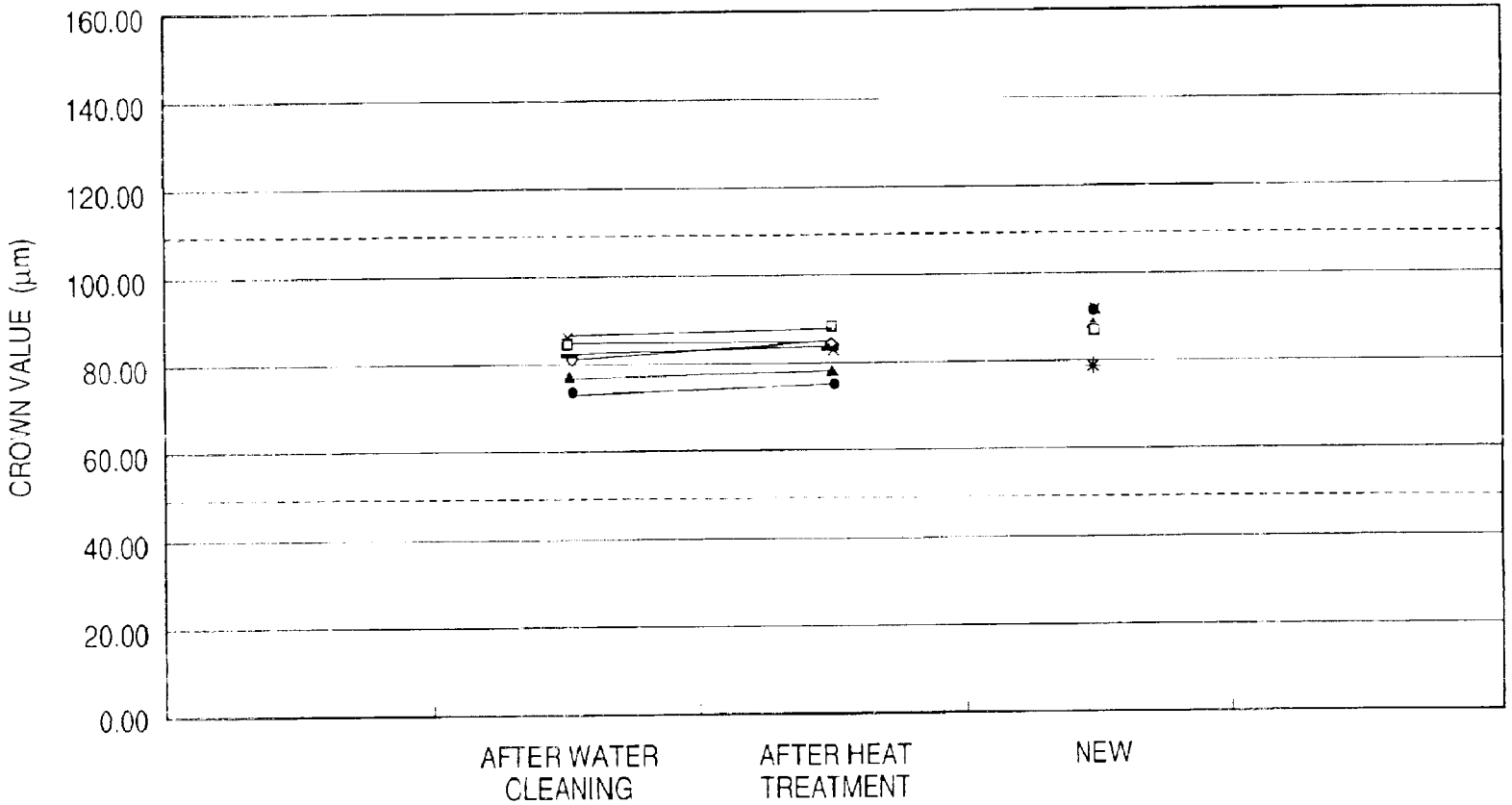
FIG. 5 is a graph showing the change in crown value after water cleaning and after heat treatment of charging rolls in Reference Examples.

The outer diameter data of new charging rolls (NEW) is a data (reference value) of samples produced in another lot. A crown value specification is from 50 to 10 μm. The results are shown in Table 6, and graphically illustrated in FIG. 5.

TABLE 6

Change in crown value after water cleaning and after heat treatment

| | After water cleaning | After heat treatment | NEW |
|---|---|---|---|
| 1 | 86.5 | 86.0 | 90.0 |
| 2 | 85.5 | 84.0 | 91.5 |
| 3 | 74.5 | 75.5 | 77.5 |
| 4 | 88.0 | 88.5 | 91.0 |
| 5 | 83.0 | 84.5 | 89.5 |
| 6 | 82.5 | 84.5 | 91.0 |
| 7 | 87.0 | 88.5 | 90.0 |
| 8 | 78.0 | 79.0 | 89.5 |
| 9 | 87.5 | 85.5 | 88.0 |
| 10 | 85.0 | 83.5 | 88.5 |

unit: μm

The results in Table 6 (FIG. 5) reveal that the crown value is almost unchanged by the heat treatment and the charging roll can be reused in a good condition.

Change in Hardness After Water Cleaning and After Heat Treatment

A hardness of new charging rolls (NEW) and charging rolls after water cleaning and after heat treatment is measured.

Figure 6:
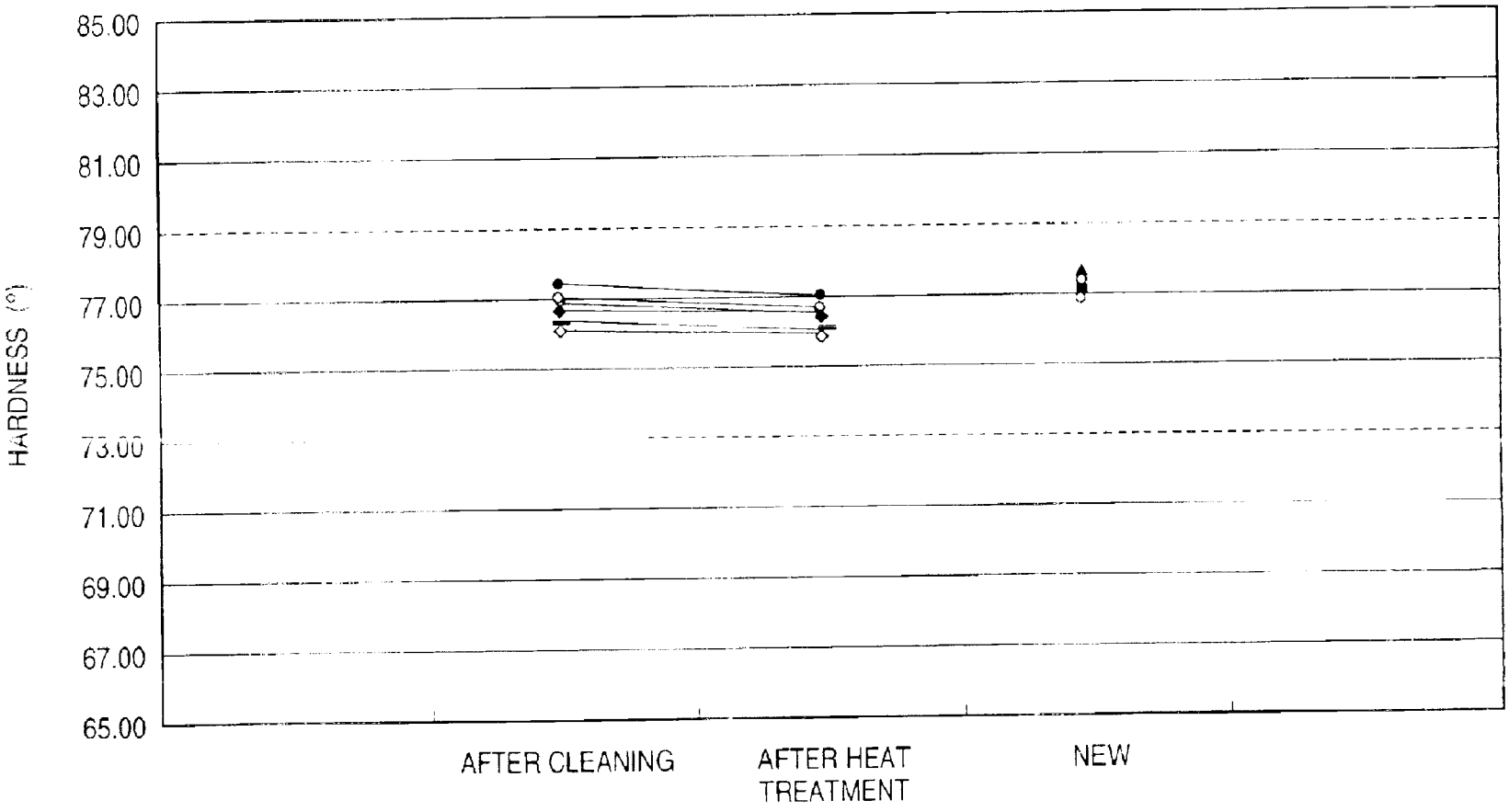
FIG. 6 is a graph showing the change in hardness after water cleaning and after heat treatment of charging rolls in Reference Examples.

The hardness of new charging rolls (NEW) is a data (reference value) of samples produced in another lot. A hardness specification is from 73 to 79°. The results are shown in Table 7, and graphically illustrated in FIG. 6.

The hardness is measured according to Asker C in JIS K-6301 by urging a needle of an Asker C-type hardness meter (manufactured by Kobunshi Keiki) against the surface of the charging roll under a load of 1,000 g.

TABLE 7

Change in hardness after water cleaning and after heat treatment

| | After water cleaning | After heat treatment | NEW |
|---|---|---|---|
| 1 | 77.50 | 77.033 | 76.90 |
| 2 | 76.80 | 76.967 | 77.10 |
| 3 | 76.90 | 76.967 | 77.27 |
| 4 | 76.23 | 76.033 | 77.47 |
| 5 | 77.27 | 76.800 | 76.80 |
| 6 | 76.43 | 76.033 | 76.97 |
| 7 | 76.87 | 76.733 | 77.00 |
| 8 | 77.27 | 76.933 | 77.20 |
| 9 | 76.80 | 76.533 | 77.13 |
| 10 | 76.47 | 76.233 | 77.70 |

unit: °

The results in Table 7 (FIG. 6) reveal that the hardness is almost unchanged by the heat treatment and the charging roll can be reused in a good condition.

Change in Surface Roughness (Rz) After Water Cleaning and After Heat Treatment

Figure 7:
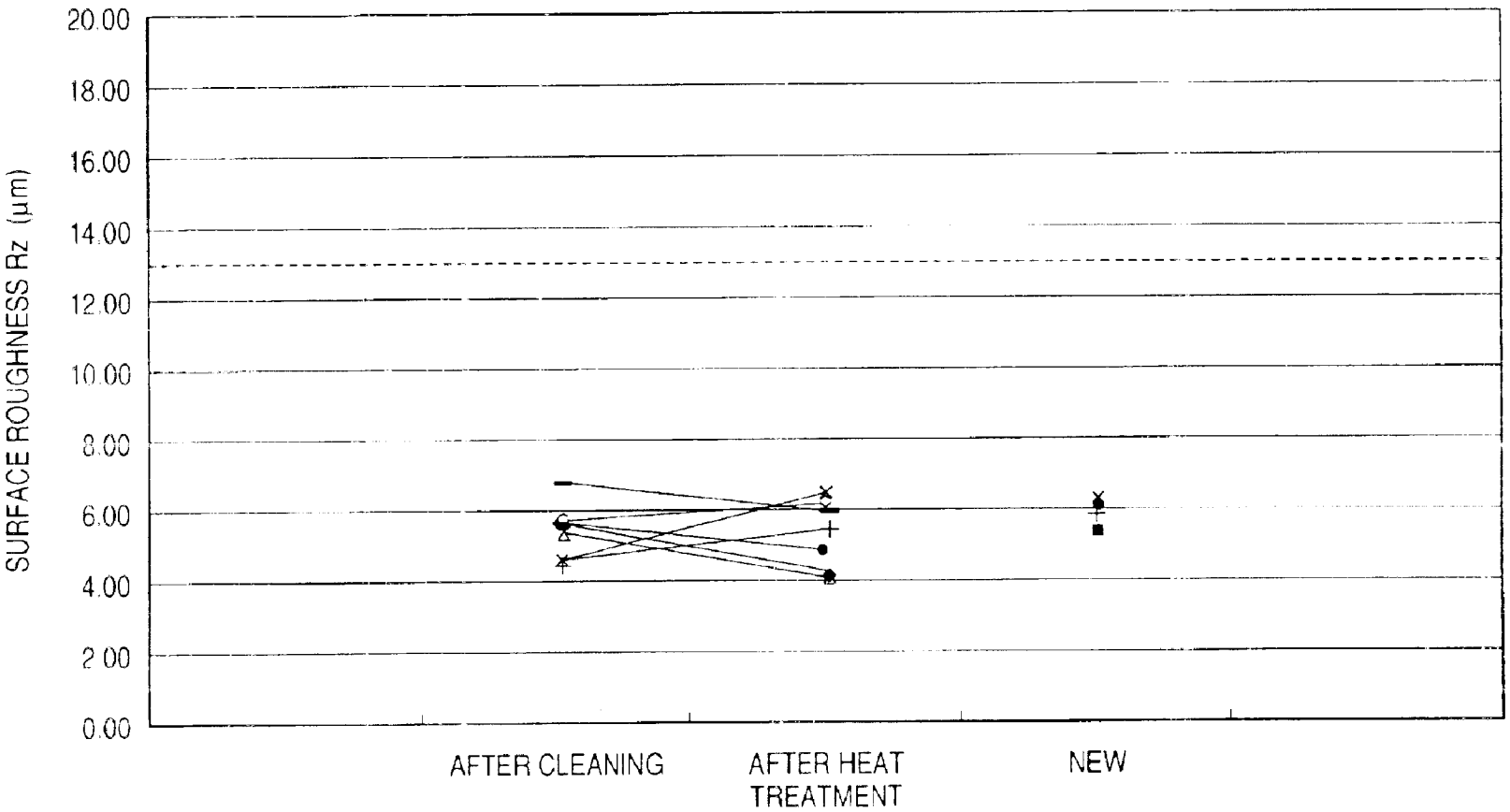
FIG. 7 is a graph showing the change in surface roughness (Rz) after water cleaning and after heat treatment of charging rolls in Reference Examples.

A surface roughness (Rz) of new charging rolls (NEW) and charging rolls after water cleaning and after heat treatment is measured. The surface roughness (Rz) of new charging rolls (NEW) is a data (reference value) of samples produced in another lot. A surface roughness (Rz) specification is 13 μm or less. The results are shown in Table 8, and graphically illustrated in FIG. 7.

The surface roughness (Rz: 10-point average surface roughness) is repeatedly measured three times by changing a position at 23° C. and 55% RH in a measurement distance of 2.5 mm using a contact-type surface roughness measuring meter (Surfcom 570A, manufactured by Tokyo Seimitsu) with a contact needle having a diamond tip (5 μm R, 90° cone). The average of the resulting values is used as Rz of the charging roll.

TABLE 8

Change in surface roughness (Rz) after water cleaning and after heat treatment

| | After water cleaning | After heat treatment | NEW |
|---|---|---|---|
| 1 | 5.53 | 5.09 | 6.28 |
| 2 | 5.17 | 5.52 | 6.08 |
| 3 | 6.77 | 6.06 | 6.28 |
| 4 | 5.52 | 4.17 | 5.94 |
| 5 | 5.37 | 4.14 | 5.88 |
| 6 | 4.58 | 6.40 | 6.35 |
| 7 | 6.15 | 4.72 | 5.34 |
| 8 | 3.38 | 5.19 | 5.70 |
| 9 | 4.60 | 5.61 | 5.41 |
| 10 | 5.58 | 6.17 | 5.38 |

unit: μm

The results in Table 8 (FIG. 7) reveal that the hardness is almost unchanged by the heat treatment and the charging roll can be reused in a good condition.

Figure 8A:
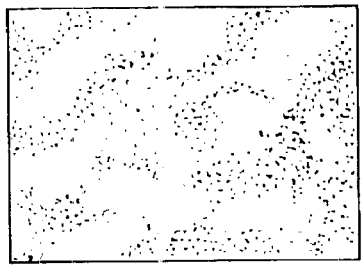
FIG. 8A is a schematic view of a dispersed state of carbon black on a surface layer of a new charging roll.
Figure 8B:
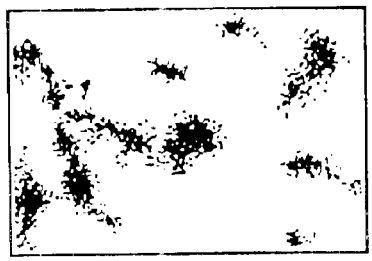
FIG. 8B is a schematic view of a dispersed state of carbon black on a surface layer of a charging roll collected from the market.
Figure 8C:
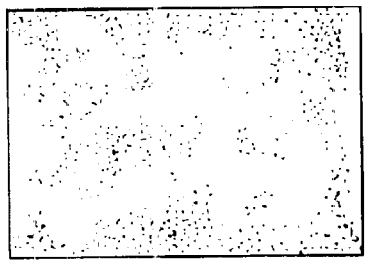
FIG. 8C is a schematic view of a dispersed state of carbon black on surface layers of used charging rolls after water cleaning and after heat treatment in Reference Examples.

Change in Dispersed State of Carbon Black on a Surface Layer After Water Cleaning and After Heat Treatment A dispersed state of carbon black on surface layers of new charging rolls, charging rolls collected from the market and used charging rolls after water cleaning and after heat treatment is measured by TEM. The dispersed state of carbon black on the surface layer of the new charging roll is schematically shown in FIG. 8A, that on the surface layer of the used charging roll collected from the market in FIG. 8B and that on the surface layers of the used charging rolls after water cleaning and after heat treatment in FIG. 8C respectively.

As shown in FIG. 8, carbon black is almost uniformly dispersed in the new charging roll, whereas carbon black is aggregated in the used charging roll collected from the market. Meanwhile, carbon black is uniformly dispersed in the charging rolls after water cleaning and after heat treatment. In the charging roll, it is considered that carbon black is aggregated due to a mechanical stress to decrease the chargeability but carbon black is uniformly dispersed again by the heat treatment to recover the chargeability.

As is apparent from these Reference Examples, the properties of the charging rolls, except the resistance, are unchanged by the heat treatment and the charging roll after the heat treatment can be reused in a good state.

As has been thus far stated above, the invention can provide a method for regenerating a charging member, which can easily regenerate and reuse a used charging member whose resistance is not decreased enough to recover a required chargeability by cleaning the surface, a charging member, and a device for regenerating a charging member.

The entire disclosure of Japanese Patent Application No. 2002-273995 filed on Sep. 19, 2002 including specification, claims, drawings and abstract is incorporated herein by reference in its entirety.

What is claimed is:

1. A method comprising:

applying heat treatment to a charging member for regenerating and reusing the charging member for an electrographic system that is pressed against a surface of a body to charge the body.

2. A method as claimed in claim 1, wherein a temperature of the heat treatment is from 150° C. to 200° C.

3. The method as claimed in claim 1, wherein a time of the heat treatment is from 15 minutes to 120 minutes.

4. The method as claimed in claim 1, further comprising:

cleaning a surface of the charging member.

5. The method as claimed in claim 1, wherein the charging member has a layer structure that at least an ion conductive layer containing an ion conductive organic material and a surface layer containing carbon black are laminated on a core material in this order.

6. The method as claimed in claim 5, wherein a base material of the surface layer in the charging member is a thermo-setting resin obtained by cross-linking an aliphatic polyester resin with a melamine resin.

7. The method as claimed in claim 5, wherein the surface layer in the charging member contains fine particles of at least one of a fluorine-containing polymer compound and a silicone polymer compound.

8. A charging member for an electrophotographic system that is pressed against a surface of a body to charge the body, the charging member is regenerated for reuse by heat treatment.

9. The charging member as claimed in claim 8, wherein the heat treatment is conducted at a temperature of from 150° C. to 200° C.

10. The charging member as claimed in claim 8, wherein the heat treatment is conducted for a time of from 15 minutes to 120 minutes.

11. The charging member as claimed in claim 8, wherein a surface of the charging member is cleaned for regeneration.

12. The charging member as claimed in claim 8, comprising:

a layer structure that at least an ion conductive layer containing a ion conductive organic material and a surface layer containing carbon black are laminated on a core material in this order.

13. The charging member as claimed in claim 12, wherein a base material of the surface layer in the charging member is a thermo-setting resin obtained by cross-linking an aliphatic polyester resin with a melamine resin.

14. The charging member as claimed in claim 12, wherein the surface layer in the charging member contains fine particles of at least one of a fluorine-containing polymer compound and a silicone polymer compound.

15. A device for regenerating a charging member, comprising:

a heat treatment unit that applies heat treatment to the charging member for regenerating and reusing the charging member.

16. The device for regenerating a charging member as claimed in claim 15, further comprising:

a cleaning unit that cleans the charging member.

* * * * *